US006700084B2

(12) United States Patent
Shibata et al.

(10) Patent No.: US 6,700,084 B2
(45) Date of Patent: Mar. 2, 2004

(54) SWITCH STRUCTURE WITH ELECTRICAL DEVICE

(75) Inventors: Takeshi Shibata, Tokyo (JP); Hideaki Akimoto, Tokyo (JP)

(73) Assignee: Niles Parts Co., Ltd. (JP)

( * ) Notice: Subject to any disclaimer, the term of this patent is extended or adjusted under 35 U.S.C. 154(b) by 0 days.

(21) Appl. No.: 09/785,476

(22) Filed: Feb. 20, 2001

(65) Prior Publication Data

US 2002/0112947 A1 Aug. 22, 2002

(30) Foreign Application Priority Data

Feb. 21, 2001 (JP) ..... 2000-043100

(51) Int. Cl.[7] ..... H01H 15/06
(52) U.S. Cl. ..... 200/252; 200/61.27
(58) Field of Search ..... 200/61.54, 61.27, 200/252

(56) References Cited

U.S. PATENT DOCUMENTS 4,212,000 A * 7/1980 Yamada ..... 200/11 R
4,288,787 A * 9/1981 Serras-Paulet ..... 200/16 D
4,316,067 A 2/1982 Whiteman
4,652,706 A * 3/1987 Rao et al. ..... 200/1 R

FOREIGN PATENT DOCUMENTS

| | | |
|---|---|---|
| EP | 0 131 185 | 1/1985 |
| EP | 0 135 199 | 2/1991 |
| JP | 5-79843 | 10/1993 |
| JP | 07 073778 | 3/1995 |
| JP | 9-63415 | * 3/1997 |
| JP | 09 063415 | 3/1997 |

OTHER PUBLICATIONS

European Search Report dated Apr. 23, 2001 for Application No. Ep 01 10 4072.

* cited by examiner

*Primary Examiner*—Renee Luebke
(74) *Attorney, Agent, or Firm*—Rader, Fishman & Grauer PLLC

(57) ABSTRACT

A switch device is provided, which has a function of preventing reverse flow of current and reducing the number of switch terminals or harnesses. The switch device has a plurality of fixed contacts and a plurality of movable contacts to contact the fixed contacts. The movable contacts have an electronic element provided between contact members.

7 Claims, 7 Drawing Sheets

SWITCH STRUCTURE WITH ELECTRICAL DEVICE

BACKGROUND OF THE INVENTION

1. Field of the Invention

The present invention relates to a switch provided with an electronic element on a movable contact of a switch. Particularly, the invention relates to an improvement of a switch device having an electronic element, such as a diode, for preventing reverse flow of current on a contact portion to reduce the number of interconnections.

2. Description of the Related Art

Conventionally, there has been a switch device provided with several switches as in an automobile combination switch. This related art combination switch has a plurality of operation members comprising a lever, a rotary knob and a push button, and a multiplicity of contact members operating on the operation members, thus being complicated in switch-device structure. In the switch device, the increased contact members increases the number of terminals or harnesses connected to the contact members, increasing connection work and the number of parts and hence leading to the increase of cost.

There is, as a technology for eliminating such problems, a device of a combination switch disclosed, e.g., in Japanese Utility Model Preliminary Publication(KOKAI)No. 5-79843. This device is intended to simplify the structure of a combination switch and reduce cost by making the fixed contact of the switch to a common contact and controlling electronic signals of each switch by one electronic control circuit.

The device disclosed in the foregoing publication decreases conventional five into three of output contact terminals connecting from the turn & light switch to the electronic control circuit and conventional five into three of output contact terminals connecting from the wiper & washer switch to the electronic control circuit, thereby reducing the number of parts and assembling processes. However, there are a number of switch devices in the combination switch. Even if the foregoing common contacts are used, the number of terminals and harnesses to be reduced is limited, which number still remains many.

It can be considered to make the contact portions of an electric circuit as shown in FIG. 11 into a matrix as a means to further reduce the number of contact terminals in the related art. In FIG. 11, 68 is an electronic control circuit of a combination switch, 69 is a contact portion made in matrix of a turn & light switch and wiper & washer switch, and 70 are lead wires connecting between the contact portion 69 and the electronic control circuit 68. It is possible to further reduce the number of contact terminals by making a matrix in this manner.

However, in the combination switch that the related art contact portion 69 is made in a matrix, one lead wire can be utilized for signals exclusive for the lighting system and another for signals exclusive for the wiper system. It can be considered that such use leads to a functional failure for the lighting system (or the wiper system) entirety in the event of occurrence of trouble, such as disconnection, in the lead wire. The lead wires in plurality are preferably used commonly to the lighting system and the wiper system.

However, it can be considered that, where connection and disconnection of the switches are to be made by switching the contacts with the lead wires used commonly, unintended contacts are simultaneously put in a connection state due to the configuration of many switches. In the case of encountering such simultaneous connection, there is a problem that malfunction occurs in the electronic control circuit 68.

Therefore, in order to prevent malfunction due to current flow-in in the electric circuit of the electronic combination switch 71 as shown in FIG. 11, it can be considered to provide a diode 72 for preventing reverse flow of current in the electric circuit within the control circuit 74 between contacts and an IC 75 or within the combination switch 71.

The combination switch 71 is provided with a multiplicity of switch devices. In the case of the wiper switch 73, for example, knob manipulation moves one movable contact 73*a* providing switching from an OFF contact 73*b* to an INT contact 73*c*, LO contact 73*d* or HI contact 73*e*. In this example, it is necessary for one of the diodes 72 to be provided between each of the output portions of the OFF contact 73*b*, the INT contact 73*c*, the LO contact 73*d* and the HI contact 73*e* and the IC 75 of the control circuit 74, thus increasing the number of diodes used and increasing the cost of the combination switch 71.

Meanwhile, where the diodes are provided on a printed board or pole board of the wiper switch 73, the occupation space of the diodes increases, thus increasing the size of the printed board or pole board and hence the overall size of the combination switch. Where conversely the pole board is limited in size, another problem arises that the diodes occupy over the board surface making it impossible to secure a space for providing fixed contacts.

SUMMARY OF THE INVENTION

It is an object of the present invention to provide a switch device having electronic elements provided in proper positions and having a reduced number of switch terminals and harnesses.

The present invention has been made in order to eliminate the foregoing problems in the related art.

(1) A switch device according to the present invention comprises a plurality of fixed contacts and a plurality of movable contacts to contact the fixed contact, wherein the movable contacts each has an electronic element provided among contact members.

(2) In the switch device as set forth in (1), the electronic element comprises a diode.

(3) In the switch device as set forth in (1) or (2), the movable contacts each has the electronic element arranged in a connecting portion where the plurality of contact members join together.

(4) In the switch device as set forth in (3), the movable contacts each has a holding member fixing the electronic element and the connecting portion where the plurality of contact members join together.

(5) In the switch device as set forth in (4), the holding member forms a mover.

(6) In the switch device as set forth in (1), (2) or (3), the movable contact comprises two conductive metal rod-like members, and the two conductive metal rod-like members each forms a contact portion in one end and has the other end fixed on an end of each of the electronic elements.

(7) In the switch device as set forth in (1), (2), (3), (4), (5) or (6), the movable contacts each constitutes a contact member for an automobile combination switch.

DESCRIPTION OF THE PREFERRED EMBODIMENTS

First Embodiment

Figure 1:
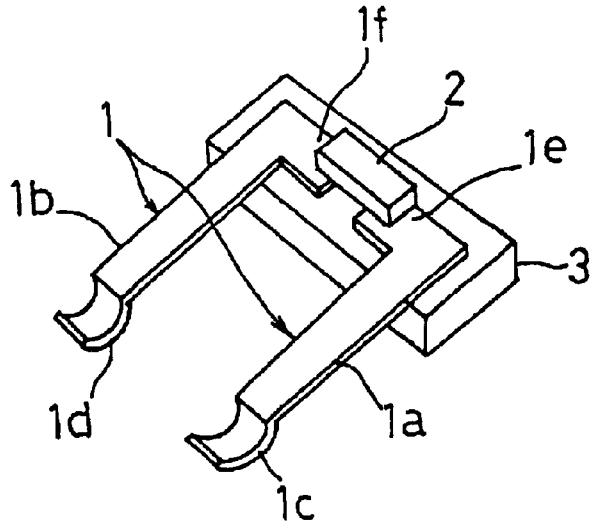
FIG. 1 is a drawing showing a first embodiment in the present invention, which is a perspective view showing a movable contact having an electronic element.

First, a first embodiment of the present invention will be described in detail based on FIG. 1.

1 is a movable contact having, for example, two contact members 1*a,* 1*b* to be contacted with a plurality of fixed contacts (not shown). The movable contact 1 has an electronic element 2 between the contact members 1*a,* 1*b*.

The contact members 1*a,* 1*b* comprise, for example, conductive metal plate spring members, the respective of which are symmetric in form. Incidentally, although the contact members 1*a,* 1*b* are two in number, they are not limited to two but, as required, may be increased to a predetermined number.

The contact member 1*a,* 1*b* forms, at one end, a contact portion 1*c,* 1*d* to be contacted with a fixed contact and, at the other end, a connection portion 1*e,* If firmly fixed to the electronic element 2 through solder or the like. The contact 1*c,* 1*d* of the movable contact 1 comprises a slide contact that slides on a contact board and contacts the fixed contact when the switch is operated.

The electronic element 2 comprises a diode in the form of a chip to prevent, for example, reverse flow of current. The electronic element 2 is provided between the contact portions 1*e,* 1*f* and fixed by resting a peripheral position of the providing portion on a holding member 3 comprising a plate member formed, for example, of resin. Due to this, only a current in a predetermined direction flows through the contact member 1*a,* 1*b* of the movable contact 1.

The holding member 3 is to hold the movable contact 1 and the electronic element 2 and is formed of an insulating material such as resin. The holding member 3 is to be mounted on a mover (not shown) or operating member (not shown) of the switch device. Incidentally, the holding member 3 may provide a movable-member main body that is caused to move by interacting with a knob of an operation lever or rotary switch.

Second Embodiment

Figure 2:
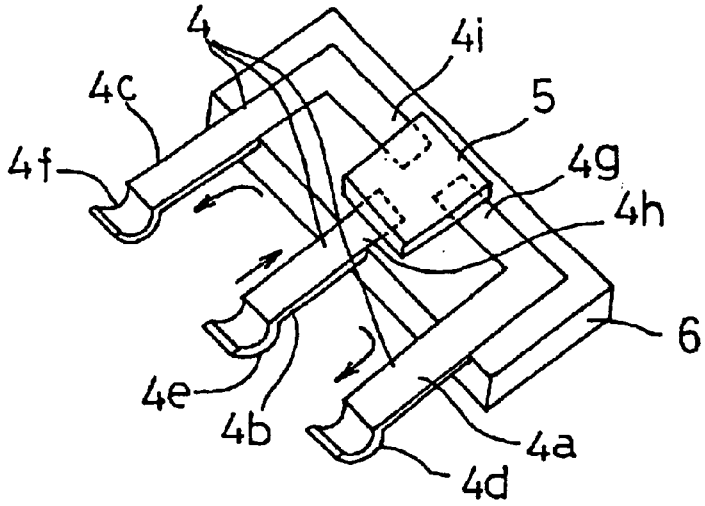
FIG. 2 is a drawing showing a second embodiment in the present invention, which is a perspective view showing a movable contact having an electronic element.

Next, a second embodiment in the invention will be described in detail based on FIG. 2.

The second embodiment of the invention is that the movable contact 1 comprising the two contact members 1*a,* 1*b* in the foregoing first embodiment is structured by three contact members 4*a,* 4*b,* 4*c*.

The moving contact 4 has an electronic element 5 provided on connecting portions 4*g,* 4*h,* 4*i* joining the ends of the contact members 4*a,* 4*b,* 4*c*. The contact members 4*a,* 4*b,* 4*c* comprise conductive metal plate spring members similarly to the first embodiment.

The contact members 4*a,* 4*b,* 4*c* each has a contact portion 4*d,* 4*e,* 4*f* formed at one end to be contacted with a fixed contact (not shown), and has a connecting portion 4*g,* 4*h,* 4*i* formed at the other end to be firmly fixed to the electronic element 5 through solder or the like.

The electronic element 5 comprises a diode having, for example, two diodes made into one chip. The electronic element 5 is provided between the three contact portions 4*g,* 4*h,* 4*i* and fixed by resting a peripheral position of the provided portion on the holding member 6. Due to this, only a current in a predetermined direction, for example, shown by the arrows in FIG. 2 flows through the contact members 4*a,* 4*b,* 4*c* of the movable contact 4.

Third Embodiment

Figure 3:
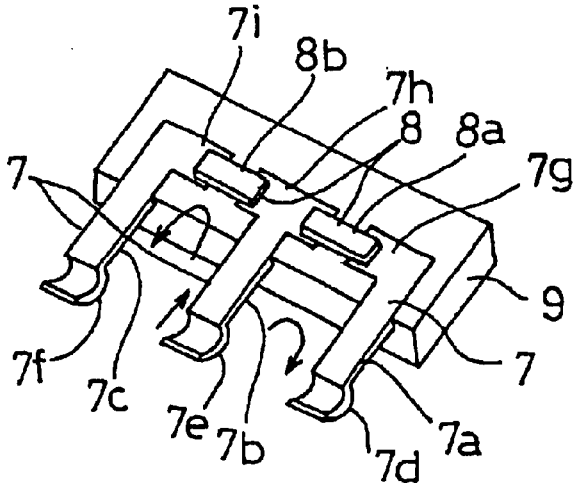
FIG. 3 is a drawing showing a third embodiment in the present invention, which is a perspective view showing a movable contact having an electronic element.

Next, a third embodiment in the invention will be described in detail based on FIG. 3.

The third embodiment of the invention is structured by increasing to two the one electronic element 5 provided between the movable contact 4 comprising the three contact members 4*a,* 4*b,* 4*c* in the foregoing second embodiment.

The movable contact 7 has an electronic element 8 comprising two electronic elements 8*a,* 8*b* provided on connecting portions 7*g,* 7*h,* 7*i* joining the ends of the contact members 7*a,* 7*b,* 7*c*. The movable contact 7 comprises conductive metal plate spring members similarly to the first and second embodiments. The contact member 7*a,* 7*b,* 7*c* each have a contact portion 7*d,* 7*e,* 7*f* formed at the other end to be contacted with a fixed contact, and a connecting portion 7*g,* 7*h,* 7*i* to be soldered to the electronic elements 8*a,* 8*b* through solder or the like.

The electronic element 8 comprises a member similar to the foregoing first embodiment. The electronic element 8*a* is provided between the contact portion 7*g* and the contact portion 7*h,* and fixed by resting at a peripheral position of the providing portion on the holding member 9. The electronic element 8*b* is provided between the contact portion 7*h* and the contact portion 7*i,* and fixed by resting at a peripheral position of the providing portion on the holding member 9. Due to this, only a current in a predetermined direction shown by the arrows in FIG. 3 flows through the contact members 7*a,* 7*b,* 7*c* of the movable contact 7.

Fourth Embodiment

Next, a fourth embodiment of the invention will be described in detail based on FIG. 4.

The fourth embodiment of the invention is structured by making the movable contact 1, 4, 7 in the foregoing first to third embodiments into another-type of switch contact.

The movable contact 10 has one electronic element 11 provided on connecting portions 10*c,* 10*d* joining the ends of two symmetric-formed contact members 10*a,* 10*b,* The movable contact 10 comprises a conductive metal plate. The contact member 10*a,* 10*b* forms, at a central side, a connecting portion 10*e,* 10*f* to be firmly fixed to the electronic element 11 through solder or the like and has, in a vicinity of the connecting portion 10*e,* 10*f,* a contact portion 10*c,* 10*d* to be contacted with a fixed contact (not shown).

The electronic element 11 comprises a member similar to the foregoing first to third embodiments. The electronic element 11 is provided between the contact portion 10*e* and the contact portion 10*f,* and fixed by resting at a peripheral position of the providing portion on the holding member 12. Due to this, only a current in a predetermined direction flows through the contact member 10*a,* 10*b* of the mover 10.

Figure 4:
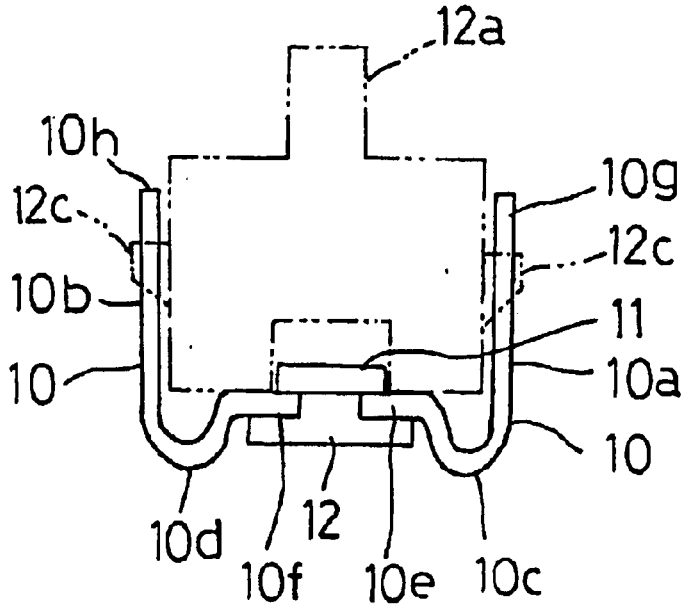
FIG. 4 is a drawing showing a fourth embodiment in the present invention, which is a perspective view showing a movable contact having an electronic element.

Incidentally, the holding member 12 may be made as a mover (not shown) having an engaging portion 12*a* for engagement with the operating member and an engaging protrusion 12*c* for engagement in a through-hole of the movable contact 10, as shown by the virtual line in FIG. 4. Also, elastic engaging protuberances 10*g,* 10*h* may be formed at both ends of the movable contact 10 and attached to an operating member (not shown) or mover through a contact spring (not shown).

Fifth Embodiment

Figure 5:
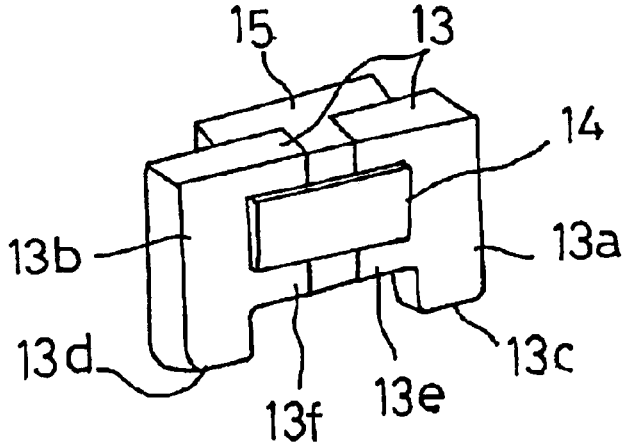
FIG. 5 is a drawing showing a fifth embodiment in the present invention, which is a perspective view showing a movable contact having an electronic element.

Next, a fifth embodiment will be described in detail based on FIG. 5.

The fifth embodiment is structured by making the movable contact 10 in the foregoing fourth embodiment into a thick-plated switch contact.

The movable contact 13 has one electronic element 14 provided on connecting portions 13*c,* 13*d* joining, face-to-face, the ends of contact members 13*a,* 13*b* comprising two symmetric forms. The movable contact 13 comprises a thick conductive metal plate. The contact members 13*a,* 13*b* form, on a central side, a connecting portion 13*e,* 13*f* to be firmly fixed to the electronic element 14 and has, at a lower portion, a contact portion 13*c,* 13*d* to be contacted with a fixed contact.

The electronic element 14 comprises a member similar to the foregoing first, third and fourth embodiments. The electronic elements 14 is attached on one side between the contact portion 13*e* and the contact portion 13*f,* and fixed by providing a holding member 15 on the other side of the providing portion. Due to this, only a current in a predetermined direction flows through the contact member 13*a,* 13*b* of the movable contact 13.

Incidentally, the holding member 15 may be engaged with the operating member or structure part of the mover.

Sixth Embodiment

Figure 6:
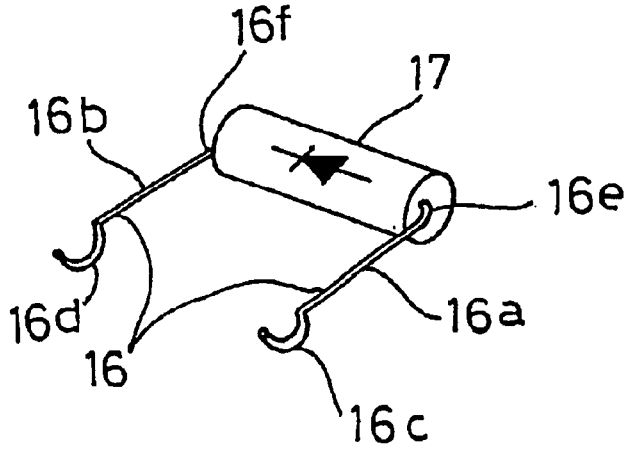
FIG. 6 is a drawing showing a sixth embodiment in the present invention, which is a perspective view showing a movable contact having an electronic element.

Next, a sixth embodiment in the invention will be described in detail based on FIG. 6.

The sixth embodiment is that the movable contacts 1, 10, 13 in the foregoing first, fourth and fifth embodiments are structured by a switch contact comprising a conductive rod spring member and lead terminals, which are commonly provided for the movable contacts 1, 10, 13 and the electronic elements 2, 11, 14.

The electronic element 17 is fixed, at both ends, to contact members 16*a,* 16*b,* which serve also as lead terminals for the electronic element 17. The electronic element 17 has a reverse-current preventing function for diode current. The movable contact 16 comprises two symmetric-formed contact members 16*a,* 16*b* and has, at one end, contact portions 16*c,* 16*d* to be contacted with a fixed contact. One electronic element 17 is provided in connecting portions 16*e,* 16*f* at the other end of the movable contact 16. The movable contact 16 and the electronic element 17 are held, for example, by a mover (not shown).

Seventh Embodiment

The electronic element 17 is fixed, at both ends, to contact members 16*a*, 16*b*, which serve also as lead terminals for the electronic element 17. The electronic element 17 has a reverse-current preventing function for diode current. The movable contact 16 comprises two symmetric-formed contact members 16*a*, 16*b* and has, at one end, contact portions 16*c*, 16*d* to be contacted with a fixed contact. One electronic element 17 is fixed to the connecting portions 16*e*, 16*f* at the other end of the moveable contact 16. The moveable contact 16 and the electronic element 17 are held, for example, by a mover (not shown).

Figure 7:
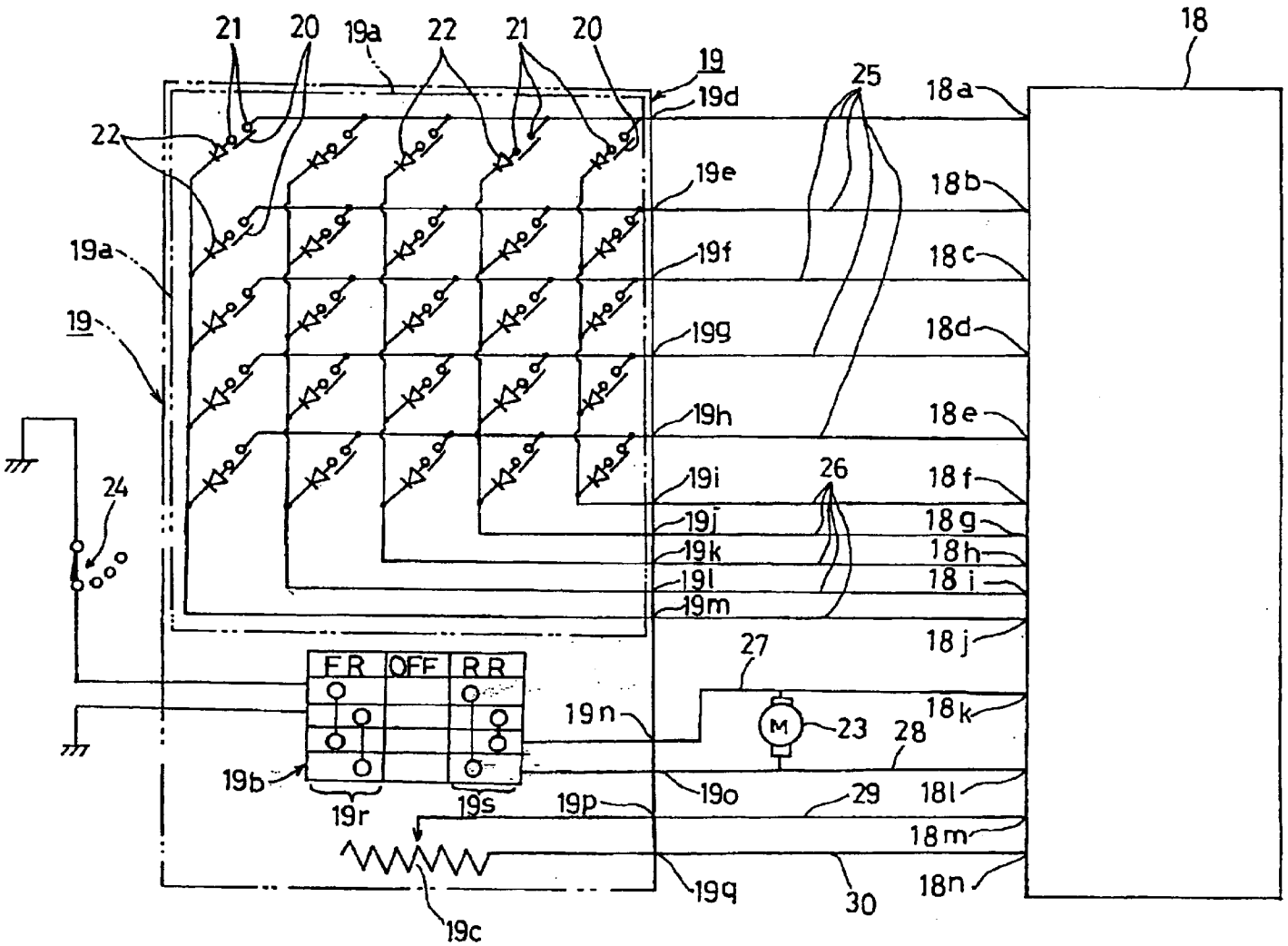
FIG. 7 is an electronic circuit diagram of a combination switch having a switch structure according to the present invention.

A seventh embodiment of the invention will be described in detail based on FIG. 7.

The seventh embodiment of the present invention in the above configuration. The operation of the invention according to the seventh embodiment will next be described in detail.

18 is a control unit for controlling various devices by controlling signals from the combination switch 19. The control unit 18 has control functions, for example, of switching a headlight switch to ON, OFF, HI and LO, switching a tail lamp to ON and OFF, switching a turn signal indicator of a flickering turn signal indicator switch to ON and OFF, switching a cornering lamp to ON and OFF, switching a fog lamp switch to ON and OFF, switching a rear-fog lamp switch to ON and OFF, switching a front wiper switch to ON, OFF, INT, LO and HI, and switching a rear wiper switch to INT, ON and OFF.

The control unit 18 has five output terminals 18*a,* 18*b,* 18*c,* 18*d,* 18*e* and five input terminals 18*f,* 18*g,* 18*h,* 18i, 18*j* connected to a contact position 19*a* of the combination switch 19, an output terminal 18*k* and input terminal 181 connected to a washer device 19*b,* and an output terminal 18*m* and input terminal 18*n* connected to a wiper volume 19*c*.

The combination switch 19, at the contact position 19*a,* has input terminals 19*d,* 19*e,* 19*f,* 19*g,* 19*h* and output terminals 19*i,* 19*j,* 19*k,* 191, 19*m* each connected through harnesses 25, 26, 27, 28, 29, 30 to the five output terminals 18*a,* 18*b,* 18*c,* 18*d,* 18*e* and five input terminals 18*f,* 18*g,* 18*h,* 18*i,* 18*j* of the control unit 18.

The contact position 19*a* is connected with the five of the input terminals 19*d,* 19*e,* 19*f,* 19*g,* 19*h* and five of the output terminals 19*i,* 19*j,* 19*k,* 191, 19*m* to have 25 points of connection points. Each of the 25 connection points has a movable contact 20, a fixed contact 21 and an electronic element 22 respectively corresponding to the movable contact 1, 4, 7, 10, 13, 16, the fixed contact and the electronic element 2, 5, 8, 11, 14, 17 that are for preventing reverse flow of current as explained in the foregoing first to sixth embodiments.

By providing the electronic element 22 having a function of preventing reverse flow of diode current at the movable contact 20 and fixed contact 21, current is prevented from reverse flowing in other direction than the predetermined direction thus preventing the combination switch 19 from malfunctioning.

The contacts 19*r,* 19*s* of the washer device 19 and the contact of the wiper volume 19*c* comprise contacts independent of the foregoing contact position 19*a.*

The washer device 19*b* has an output terminal 18*k* of the control unit 18, an input terminal 19*n* and output terminal 19*o* connected to the input terminal 181, and connected with a washer motor 23 in parallel with the output terminal 18*k* and input terminal 181. The washer device 19*b* is provided with a contact 19*r* for the front glass and a contact 19*s* for the rear glass, and wash-operates by the one washer motor 23. The washer device 19*b* has the fixed contact on the power supply side to be connected to an ignition switch 24 and is grounded on a ground side.

The wiper volume 19*c* is connected to the output terminal 18*m* and input terminal 18*n* of the control unit 18 directly through the input terminal 19*p* and output terminal 19*q.*

The seventh embodiment in the present invention is in at the above configuration. The operation of it will be described in detail.

The above seventh embodiment of the invention is provided, at the movable contact 20, with the electronic element 22 comprising a diode for current-reverse-flow prevention, thereby preventing reverse flow of current in the contact position 19*a* of the electronic circuit.

This makes possible to provide the contact position 19*a* and to make the connection terminals of the combination switch 19 having a multiplicity of contacts into respective five of input terminals 19*d,* 19*e,* 19*f,* 19*g,* 19*h* and output terminals 19*i,* 19*j,* 19*k,* 191, 19*m,* for example, as shown in the seventh embodiment of the invention. The output terminals 18*a,* 18*b,* 18*c,* 18*d,* 18*e* and the input terminal 18*f,* 18*g,* 18*h,* 18*i,* 18*j* of the control unit 18 are each reduced to five, making possible to reduce the number and connection operation of the harnesses for connecting them and decreasing the cost.

Next, an example of a combination switch using the present invention will be described in detail based on FIG. 8 to FIG. 10.

Figure 8:
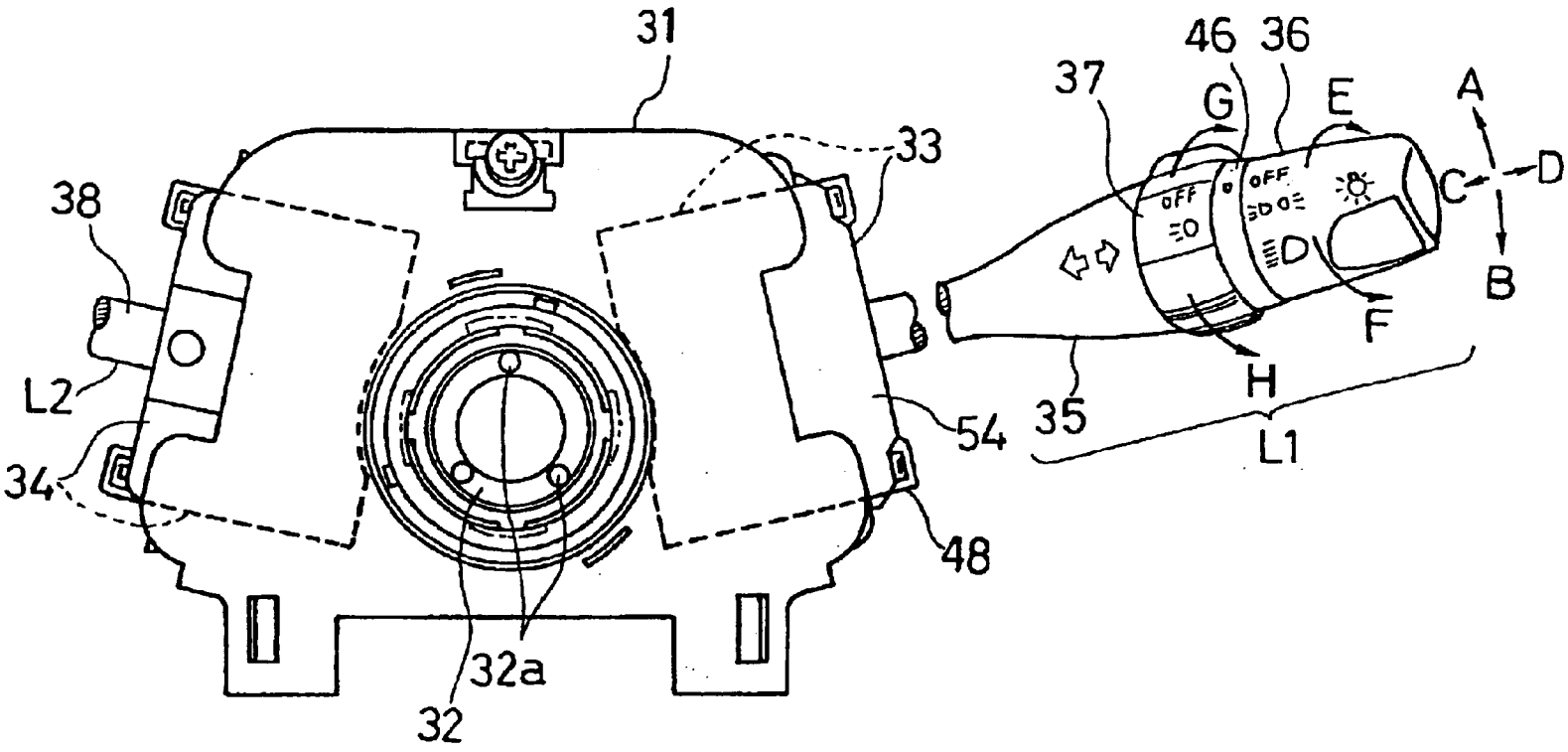
FIG. 8 is an essential part magnifying plan view of the combination switch.

31 is a combination switch body for an automobile as shown in FIG. 8, which is screw-fastened to a steering column (not shown). The body 31 is rotatably support about a central axis by a cylindrical pipe 32 having cancel pins 32*a* in a center, and inserted with a first switch 33 on a right side and a second switch 34 on a left side in right and left direction of the body 31.

The first switch 33 has functions, for example, of a turn signal indicator switch, a passing switch, a main-dimmer selector switch, a headlight switch and fog lamp switch. The first switch 33 has a function of a turn signal indicator switch to cause the turn signal indicator to flicker if an operation lever L1 is operated in a left-right direction of an arrow A-B direction. The first switch 33 has a function of a passing switch to cause the headlight to primarily go on if the operation lever L1 is operated in an arrow C direction. Also, the first switch 33 has a function of a main-dimmer selector switch to switch between main and dimmer for the headlight if the operation lever L1 is operated in the up-down direction of an arrow C, D direction.

Also, the first switch 33 has a function of a headlight switch to turn on and out the headlight and tail lamp by rotating a first rotary knob 36 provided at a tip of the lever 35 in an arrow E-F direction. Also, the first switch 33 has a function of a fog lamp switch to turn on and out the fog lamp by rotating a second rotary knob 37 in an arrow G-H direction.

The second switch 34 is axis-supported to swing an operation lever L2 having a function, for example, of a wiper-washer switch. The operation lever L2 has a lever 38 to be operated forward, backward, leftward and rightward similarly to the operation lever L1, and has a wiper volume, rear wiper switch and the like comprising a rotary switch at a tip of the lever 38.

Figure 9:
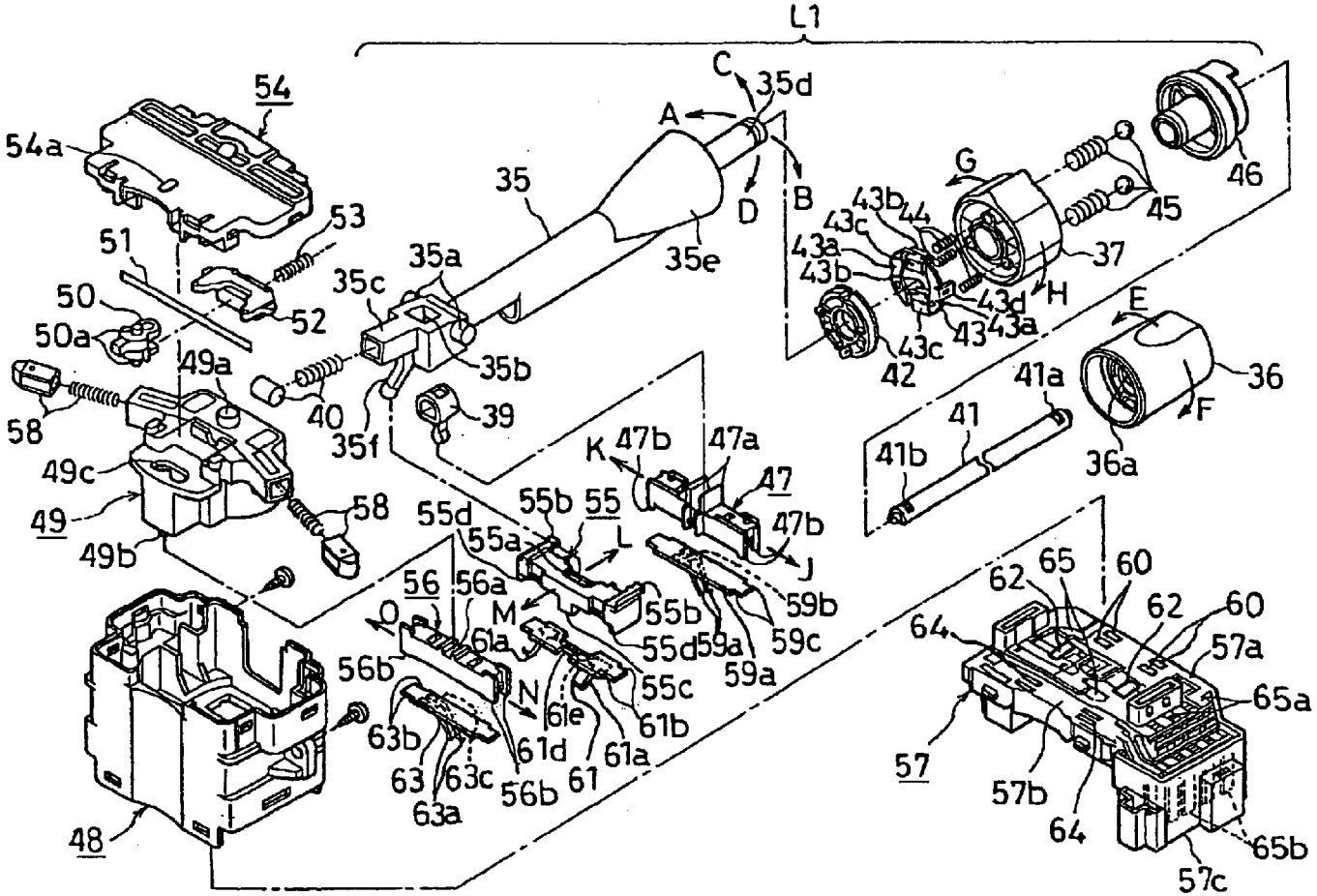
FIG. 9 is an essential part exploded view of the combination switch.

The lever 35 of the first switch 33 rotates in an arrow C-D direction about a shaft 35*a,* as shown in FIG. 9. The lever 35 is a generally cylindrical operation member and has a penetration hole 35*b* opened to arrange a first coupling portion 39 in the vicinity of the shaft 35*a.* The operation lever 35 is formed with a first cylindrical portion 35*c* to arrange a nodal member 40 at one end and, at the other end, a second cylindrical member 35*d* for inserting a shaft 41 and for arranging a board 42, movable contact 43, contact spring 44, second rotary knob 37, nodal member 45 and fixing member 46.

The lever 35 is integrally formed with a second coupling portion 35*f* fitted with a play in an engaging portion 55*a* comprising a hole of a second mover 55 on a lower side in the vicinity of the first cylindrical member 35*c.* If the lever 5 is operated in the arrow C-D direction, the second mover 55 linearly moves in an arrow L-M direction making possible to perform main-dimmer switching and passing.

The first rotary knob 36 is opened with an axial hole 36*a* in a center, and fixed to the shaft 41 by engaging an elastic engaging pawl (not shown) formed in the axial hole 36*a* with an engaging groove 41*a* of the shaft 41. By rotating the first rotary knob 36 in the arrow E-F direction, the first coupling portion 39 firmly fixed on the other end of the shaft 41 linearly moves the first mover 47 in an arrow J-K direction thus putting on and off the headlight.

The second rotary knob 37 is an operating member generally in a doughnut form, which turns the fog lamp on and off by being rotated in the arrow H-G direction. The second rotary knob 37 engages an engaging piece 43*d* of the movable contact 43 through the contact spring 44 on a case 48 side, and has a nodal member 45 arranged on a side of the first rotary knob 36. The second rotary knob 37 is inserted over the second cylindrical portion 35*d* of the operation lever 35, and is rotatably sandwiched by an aperture 35*e* opened in a trumpet form and the fixing member 46 firmly fixed on the second cylindrical members 35*d.*

Figure 10:
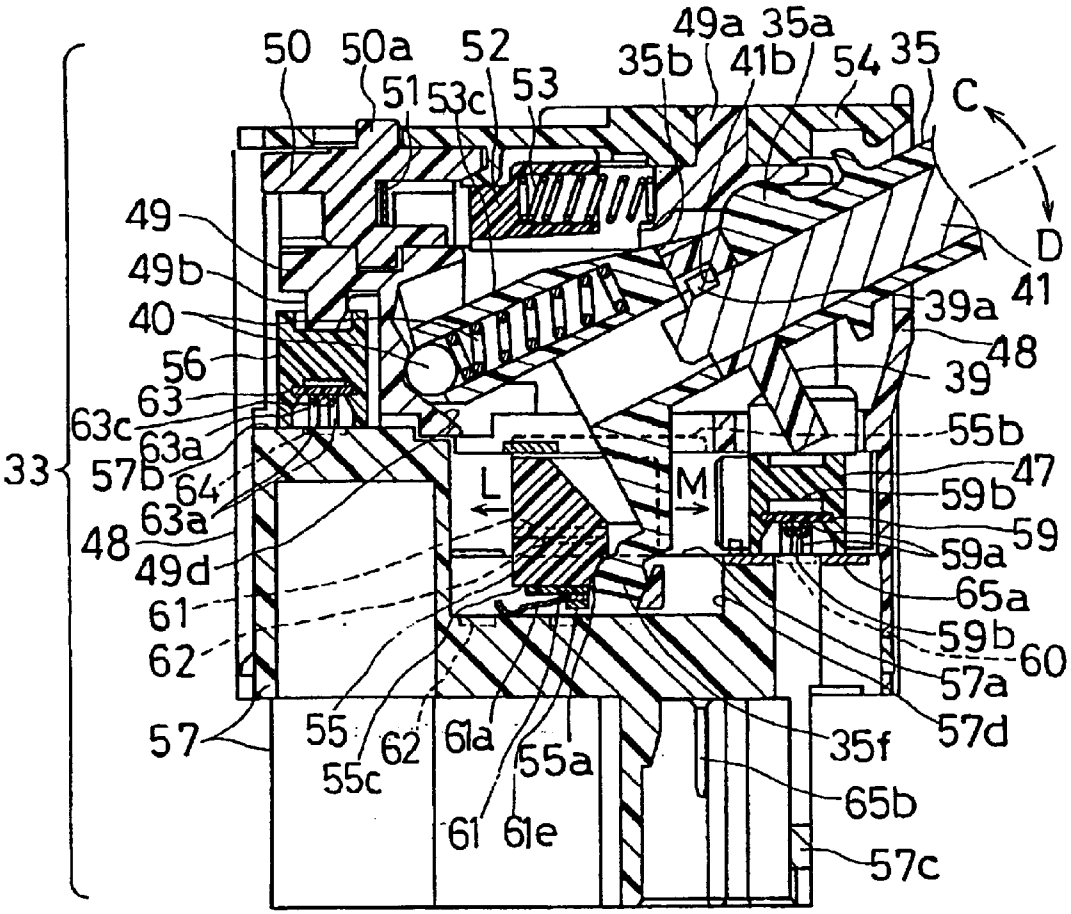
FIG. 10 is an essential part magnifying longitudinal sectional view of the combination switch.
Figure 11:
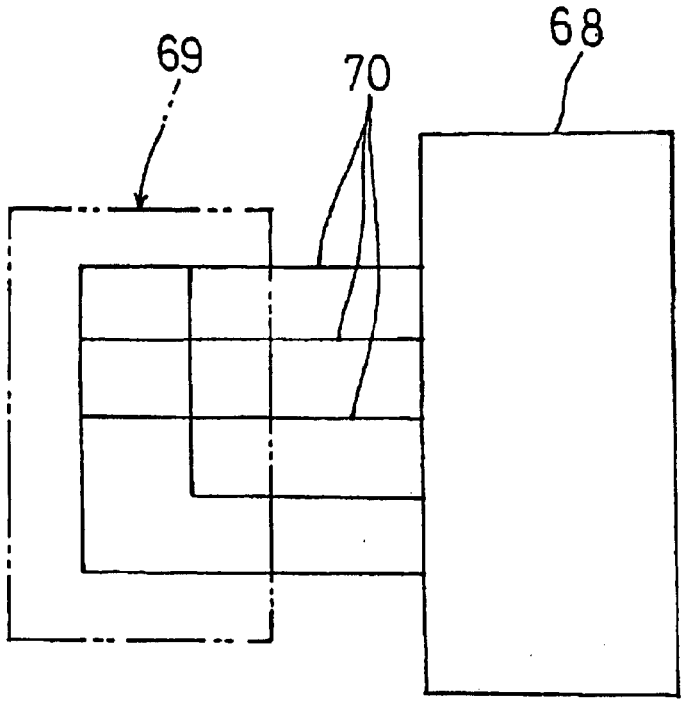
FIG. 11 is an electric circuit diagram showing an electric circuit of a related art combination switch.
Figure 12:
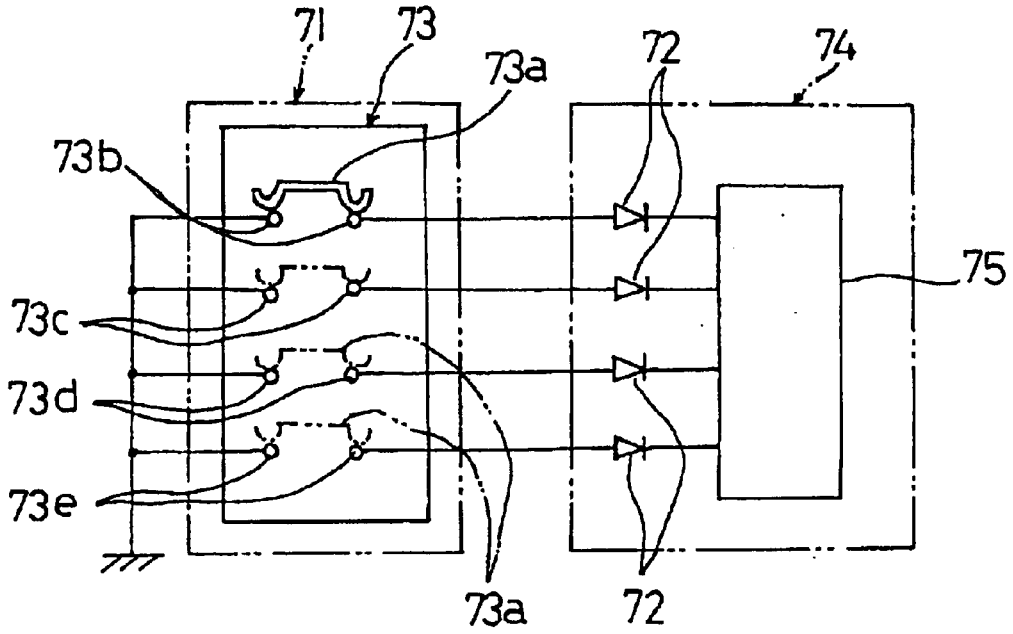
FIG. 12 is an electric circuit diagram showing an electric circuit of a related art combination switch.

The first coupling portion 39 is axially stopped at an end of the shaft 41 by engaging the elastic engaging pawl 39*a* in the engaging groove 41*b* of the shaft 41, as shown in FIG. 10. The first coupling portion 39 rotates together with the shaft 41 and first rotary knob 36 and engages the engaging portion 47*a* comprising a protuberance, whereby the rotation of the first rotary knob 36 converts the first mover 47 into linear movement to be delivered. The board 42 has a fixed contact to be contacted with the movable contact 43 and is fitted in the aperture 35*e.*

The movable contact 43 comprises arcuate movable contacts 43*a,* 43*a* in a left-and-right symmetric form as in the fourth embodiment of the invention, wherein the two movable contacts 43*a,* 43*a* is fixed by a holding member 43*c* and both are connected to each other by an electronic element 43*b.* The holding member 43*c* comprises an insulator such as resin. The electronic element 43*b* comprises a diode to prevent reverse flow of current. Due to this, only a current in a predetermined direction flows through the two movable contacts 43*a,* 43*a.* The movable contact 43 engages the engaging piece 43*d* with the second rotary knob 37 through the contact spring 44.

The nodal member 40, as shown in FIG. 10, is accommodated in the first cylindrical portion 35*c* and press-contacted with a nodal groove 49*d* formed in an inner wall of the movable member 49. The nodal member 45 is inserted in the second rotary knob 37. The nodal member 15 is press-contacted with a nodal groove formed in an inner surface of the fixing member 36 on the second rotary-knob 37 side.

The case 48 is closed, at an upper surface, by a lid member 54 through the movable member 49, cancel cam 50, leaf spring 51, cam guide 52 and coiled spring 53. The case 48 is closed, at a lower surface, by a pole board 57 through a first mover 47, second mover 45 and third mover 46. The case 48 accommodates the above parts, and is fitted and screwed to a body 31.

The movable member 49 is elastically fitted, at left and right, with nodal members 58, and rotates together with the operation lever L1 in the arrow A-B direction about the shaft 49*a*. The movable member 49 is protrusion-formed, in a lower end, with a third coupling portion 49*b* to be engaged with an engaging portion 56*a* of the third mover 56. If the operation lever L1 is swung in the arrow A-B direction, the third mover 56 linearly moves in the arrow N-O direction to put on the turn signal indicator.

The cancel cam 50 has shafts 50*a* in the upper and lower sides. The lower shaft 50*a* is fitted with play in a support groove 49*c* of the movable member 49 of the lower shaft 50*a*. The upper shaft 50*a* is fitted in an elongate hole 54*a* of the lid member 54. The leaf spring 51 at both ends is held by the lid member 54. The leaf spring 51 at both ends is held by the lid member 54, and at a center presses and urges the cancel cam 50. A cam guide 53 rests on the movable member 49 and is urged toward the cancel cam 50 by the coiled spring 53. The lid member 54 is fitted on an upper aperture end of the case 48.

The first mover 47 engages a first holding member 59 comprising an insulator such as a board by elastic engaging pawls 47*b* formed at a plurality of positions in a lower surface. The first mover 47, if the first rotary knob 36 is rotated in the arrow E-F direction, moves together with the first holding member 59 in the arrow K-J direction on a first board surface 57*a* of the pole board 57.

The first holding member 59 comprises an insulator, for example, as explained in the foregoing first embodiment in the invention. The first holding member 59 comprises a printed circuit board firmly fixed, in a lower surface, with movable contacts 59*a*, 59*a* to be contacted with the fixed contact 60 and an electronic element 59*b* comprising a diode for preventing reverse flow of current. The movable contacts 59*a*, 59*a* comprise two conductive metal plate spring members, which fixes both base ends on the first holding member 59 and connects the two movable contacts 59*a*, 59*a* by the electronic element 59*b*. Due to this, only a current in a predetermined direction flows between the movable contacts 59*a*, 59*a*, preventing reverse flow of current.

The first holding member 59 forms, in a periphery, an engaging portion 59*c* to engage the elastic engaging pawl 47*b*. Incidentally, the first holding member 59 may be fixed to the first mover 47 by screws or the like, wherein attaching means is not especially limited.

The second mover 55 engages the second holding member 61 by elastic engaging pawls 55*d* or the like formed at a plurality of positions in a lower surface. The second mover 55, if the operation lever L1 is rotated in the arrow C-D direction, moves together with the second holding member 51 in the arrow L-M direction over the first board surface 57*a* of the pole board 57.

An engaging portion 55*a* of the second mover 55 comprises an elongate hole. When the operation lever L1 is swung in the arrow A-B direction, the second coupling member 35*f* inactively moves in the engaging portion 55*a* so that the second mover 55 does not move. 55*b* is a guide arm which slides on an inner wall of the case 48 to prevent chatter of the second mover 55. 55*c* is a guide protrusion formed in a lower surface of the second mover 55, which engages a guide hole 57*d* of a first board surface 57*a*. The second mover 55 is guided by the guide arm 55*b* and the guide protrusion 55*c* to linearly move in a desired direction without chattering.

The second holding member 61 comprises an insulator of a structure as explained in the foregoing first embodiment in the invention. The second holding member 61 has movable contacts 61*a*, 61*a* for the main-dimmer switch and passing switch having a lower surface contacting the second fixed contact 62 and an electronic element 61*e*. The electronic element 61*e* comprises a diode for preventing reverse flow of current soldered between the two movable contacts 61*a*, 61*a*. The movable contacts 61*a*, 61*a* comprises two conductive metal plate spring members, which fixes both base ends on the second holding member 61 and connects the two movable contacts 61*a*, 61*a* by the electronic element 61*e*. Due to this, only a current in a predetermined direction flows between the movable contacts 61*a*, 61*a*.

The second holding member 61 forms a cutout 61*c* matched to the engaging portion 55*a* of the second mover 55 and an engaging portion 61*d* with which the guide protrusion 55*c* engages. The second holding member 61 forms, in a periphery, an engaging portion 61*e* to engage the elastic engaging pawl 55*d*. Incidentally, the second holding member 61 may be fixed to the second mover 55 by screws or the like, wherein attaching means is not especially limited.

The third mover 56 engages a third engaging member 63 by elastic engaging pawls 56*b* or the like formed in plurality in a lower surface. In the third mover 66, if the operation lever L1 is rotated in the arrow A-B direction, the movable member 49 rotates together with the operation lever L1. The engaging portion 56*a* is pulled by the third coupling portion 49*b* and moves in the arrow N-O direction together with the third holding member 63 over a second board surface 57*b* of the pole board 57*b*.

The engaging portion 56*a* comprises, for example, two rail-formed protrusions. When the operation lever 35 is swung in the arrow C-D direction, the third holding member 19*b* inactively moves in the engaging portion 56*a*, and the third mover 56 does not move.

The third holding member 63 comprises an insulator in a structure as explained in the foregoing first embodiment of the invention. The third holding member 63 has, for example in a lower surface, turn-signal-switch movable contacts 63*a*, 63*a* contacting the third fixed contact 64, and an electronic element 63*c*. The electronic element 63*c* comprises a current-reverse-preventing diode soldered between the two movable contacts 63*a*, 63*a*. The movable contacts 63*a*, 63*a* comprise two conductive metal plate spring members, and fixes both base portions to the third holding member 63 and connect the two movable contacts 63*a*, 63*a* by the electronic element 63*c*. Due to this, only a current in a predetermined direction flows between the movable contacts 63*a*, 63*a* thus preventing reverse flow of current.

The third holding member 63, if the operation lever L1 is rotated together with the third mover 66 in the arrow A-B direction, moves in the arrow N-O direction. The third holding member 63 forms, in a periphery, an engaging portion 63*b* for engagement with the elastic engaging pawl 56*b*. Incidentally, the third holding member 63 may be fixed to the third mover 56 by screws or the like, and attaching means is not especially limited.

The pole board 57 comprises a conductive plate 65 insert-molded by resin, and fitted over a lower aperture of the case 48. The pole board 57 has a first board surface 57*a* and a second board surface 57*b*. The first mover 47 and the second mover 55 are rested on the lower first board surface 57*a* and the third mover 56 on the upper second board surface 57*b*.

The pole board 57 is integrally formed with a connector portion 57*c* and has a terminal 65*b* protruding in the connector portion 57*c* and in conduction to the conducting plate 65. By the provision of the electronic element 59*b*, the terminal 65*b* can pass a current only in a predetermined direction as in the input terminal 19*d*, 19*e*, 19*f*, 19*g*, 19*h* and output terminal 19*i*, 19*j*, 19*k*, 191, 19*m* of the combination switch 19 explained in the foregoing seventh embodiment of the invention. This makes it possible to provide a contact position 19*a* on the pole board 57 and reduce the number of harnesses for connection to the terminal 65*b* and the terminal 65*b*. In the first board surface 27*a*, a guide hole 57*d* is opened with which the guide protrusion 55*c* of the second mover 55 engages.

Each conducting plate 65 comprises a terminal 65*a* provided on the first pole surface 57*a* and second pole surface 57*b*, a first fixed contact 60, a second contact 62, a third contact 64 and the terminal 65*b*. In each conducting plate 65, each terminal 65*a*, each first to third fixed contact 60, 62, 64 and each terminal 65*b* may be separately formed and put in conduction by soldering or integrally formed.

Incidentally, the movable contacts 59*a*, 61*a*, 63*a* may use movable contacts 1, 4, 7, 10, 13, 16 as explained in the foregoing first to sixth embodiment of the invention.

The example of a combination switch using the invention is described as above. Next, the operation of the combination switch will be explained in detail.

If the first rotary knob 36 is rotated in the arrow E direction to a first stage from an OFF position, the shaft 41 and first coupling member 39 rotate together with the first rotary knob 36. The first coupling member 39 is in engagement with the engaging portion 47*a* thereby moving the first mover 47 in the arrow J direction. The first holding member 59 provided on a lower surface of the first mover 47 moves (i.e., slides) together with the first mover in the arrow K and J direction over the first pole board 57*a* of the pole board 57 so that the movable contact 59*a* on the lower surface of the holding member 59 slides into contact with the first fixed contact 60 and the tail lamp goes on.

If the first rotary knob 36 is rotated further in the arrow E direction to a second stage, the shaft 41 and first coupling member 39 rotate together with the first rotary knob 36 in the manner stated above. The first coupling member 39 is in engagement with the engaging portion 47*a*, thereby further moving the first mover 47 in the arrow J direction. The first holding member 59 provided on the lower surface of the first mover 47 moves with the with the first mover 47 in the arrow J direction over the first board surface 57*a* of the pole board 57, and the movable contact 59*a* on the lower surface of the first holding member 59 comes into contact with the first fixed contact 60 causing the headlight to go on.

If the first rotary knob 36 is rotated in the arrow F direction, the members stated above move in the opposite direction to the foregoing case. The headlight goes off and the tail lamp goes off in the order, becoming in former OFF state.

If the operation lever L1 is rotated in the arrow C direction, the operation lever L1 swings about the shaft 35*a* of the lever 35. The second coupling member 35*f* moves the second mover 55 in the arrow L direction. When the second mover 55 moves in the arrow L direction, the movable contact 61*a* of the second holding member 61 provided on the lower surface moves (i.e., slides) in the arrow L direction over the first board surface 57*a* of the pole board 57 into contact with the second fixed contact 62, performing passing.

When the operation lever L1 is released from the hand, the operation lever L1 returns to the former neutral position by a slant surface of the nodal groove 49*d* with which the nodal member 40 has been in contact.

If the operation lever L1 is rotated in the arrow D direction, the operation lever L1 swings about the shaft 35*a* of the lever 35 and the second coupling member 35*f* moves the second mover 55 in the arrow M direction. If the second mover 55 moves in the arrow M direction, the movable contact 61*a* of the second holding member 61 provided on the lower surface moves (i.e., slides) in the arrow M direction over the first board surface 57*a* of the pole board 57 into contact with the second fixed contact 62, switching main-dimmer.

If the operation lever L1 is swung to a leftward position in the arrow A direction, the operation lever L1 rotates together with the movable member 49 about the shaft 49*a*. When the movable member 49 rotates, the third mover 56 with which the third coupling member 49*b* engages is moved in the arrow N direction. When the third mover 56 moves in the arrow N direction, the third holding member 63 provided on the lower surface moves (i.e., slides) together and the movable contact 63*a* slides into contact with the third fixed contact 64, flickering the left turn signal.

Then, if the operation lever L1 is operated in the opposite arrow B direction, the foregoing members move in the opposite direction, flickering the right turn signal.

By the provision of the electronic element 59*b*, 61*e*, 63*c* for preventing reverse flow of current between the movable contacts 59*a*, 59*a*, 61*a*, 61*a*, 63*a*, 63*a*, the conductive plate 65 and terminal 65*b* of the pole board 57 makes possible to provide matrix-formed contact positions as explained in the seventh embodiment of the invention and reduce the number of harnesses to be connected to the combination-switch terminal 65*b* or control unit.

The present invention was structured as explained above and hence has effects as follows.

(1) The switch device according to the present invention comprises a plurality of fixed contacts and a plurality of movable contacts to contact the fixed contact, wherein the movable contacts have an electronic element provided between contact members. Due to this, it is possible to provide electronic elements in effective places and space saving of an electric circuit board for providing electronic elements.

(2) In the switch device as set forth in (1), the electronic element comprises a diode. Due to this, it is possible to prevent current from flowing in other than a predetermined direction, and prevent the switch device from malfunctioning even if the lead-wire signals are used commonly for a signal for various switches.

(3) In the switch device as set forth in (1) or (2), the movable contacts each has the electronic element arranged in a connecting portion where the plurality of contact members join together. Due to this, it is possible to perform, at the switch contact portions, prevention against reverse flow in an electric circuit having a plurality of switch contact portions, use commonly the switch terminals or harnesses, reduce cost and simplify the electric circuit apparatus.

(4) In the switch device as set forth in (3), the movable contacts each has a holding member fixing the electronic element and the connecting portion where the plurality of contact members join together. Due to this, it is possible to easily hold the movable contact and electronic elements by the holding member to provide them in the switch device and use the holding member also as the circuit board.

(5) In the switch device as set forth in (4), the holding member forms a mover. Due to this, it is possible to easily provide the movable contact and electronic elements in the switch device and arrange the movable contact to interact with the operation member.

(6) In the switch device as set forth in (1), (2) or (3), the movable contact comprises two conductive metal rod-like members, and the two conductive metal rod-like members each forms a contact portion in one end and fixing the other end on an end of each of the electronic elements. Due to this, it is possible to commonly use the movable contact to a lead terminal of an electronic element and reduce the number of parts, such as electronic elements, and assembling processes thus reducing cost.

(7) In the switch device as set forth in (1), (2), (3), (4), (5) or (6), the movable contacts each constitutes a contact member for an automobile combination switch. Due to this, it is possible to simplify a complicated combination-switch electric circuit and reduce the number and assembling processes of electronic elements, terminals or harnesses to be connected to the terminals, thus reducing cost. Also, it is possible to prevent reverse flow of current in contact positions and provide a combination switch which is prevented from malfunctioning due to such prevention of reverse flow of current.

What is claimed is:

1. A combination switch device for an automobile, comprising:

a plurality of fixed contact groups connected to a plurality of lead wires and arranged in a matrix circuit, each fixed contact group having a plurality of fixed contacts, said lead wires being used commonly for a plurality of signals having different functions; and a plurality of movable contacts each having a plurality of contact members that slide between a plurality of positions and selectively interconnect the fixed contacts in one of said fixed contact groups when in a first one of said positions and the fixed contacts in another of said fixed contact groups when in a second one of said positions;

wherein each of the movable contacts has an electronic element comprising a diode connected between said plurality of contact members.

2. The switch device as claimed in claim 1, wherein each of the movable contacts has the electronic element arranged in a connecting portion where the plurality of contact members join together.

3. The switch device as claimed in claim 2, wherein each of the movable contacts has a holding member fixing the electronic element and the connecting portion where the plurality of contact members join together.

4. The switch device as claimed in claim 3, wherein the holding member forms a mover.

5. The switch device as claimed in claim 1, wherein each of the movable contacts comprises two conductive metal rod-like members, and the two conductive metal rod-like members each forms a contact portion in one end and has the other end fixed on an end of the electronic element.

6. The switch device as claimed in claim 1, wherein the plurality of movable contacts comprises first, second and third movable contacts of an automobile combination switch.

7. The switch device as claimed in claim 6, wherein the first movable contact provides a turn signal indicator switch, the second movable contact provides a passing switch and a main-dimmer selector switch, and the third movable contact provides a headlight switch and a fog lamp switch.

* * * * *